US009099805B2

(12) United States Patent
Hiramatsu

(10) Patent No.: US 9,099,805 B2
(45) Date of Patent: Aug. 4, 2015

(54) SPRING LOCK TYPE CONNECTOR

(71) Applicant: Sumitomo Wiring Systems, Ltd., Yokkaichi, Mie (JP)

(72) Inventor: Hiroyuki Hiramatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 134 days.

(21) Appl. No.: 14/043,004

(22) Filed: Oct. 1, 2013

(65) Prior Publication Data

US 2014/0106602 A1 Apr. 17, 2014

(30) Foreign Application Priority Data

Oct. 15, 2012 (JP) ..... 2012-227770

(51) Int. Cl.

| | |
|---|---|
| ***H01R 4/50*** | (2006.01) |
| ***H01R 13/62*** | (2006.01) |
| ***H01R 13/627*** | (2006.01) |
| ***H01R 13/639*** | (2006.01) |

(52) U.S. Cl.

CPC ..... *H01R 13/62* (2013.01); *H01R 13/6272* (2013.01); *H01R 13/639* (2013.01)

(58) Field of Classification Search

CPC ..... H01R 13/6275; H01R 13/6277

USPC ..... 439/298, 309, 345, 352; 285/317

See application file for complete search history.

(56) References Cited

U.S. PATENT DOCUMENTS

| | | | | |
|---|---|---|---|---|
| 5,639,255 | A * | 6/1997 | Muzslay | 439/347 |
| 6,585,536 | B1 * | 7/2003 | Wu | 439/358 |
| 7,588,454 | B2 * | 9/2009 | Nakata et al. | 439/357 |
| 2014/0106598 | A1 * | 4/2014 | Hiramatsu | 439/350 |
| 2014/0106602 | A1 * | 4/2014 | Hiramatsu | 439/357 |
| 2014/0106603 | A1 * | 4/2014 | Hiramatsu | 439/374 |

* cited by examiner

*Primary Examiner* — Vanessa Girardi

(74) *Attorney, Agent, or Firm* — Gerald E. Hespos; Michael J. Porco; Matthew T. Hespos

(57) ABSTRACT

A spring lock type connector has a male connector (M) with a front receptacle (52). A female connector (F) is fit on an outer peripheral side of the front receptacle (52) and has a terminal accommodating portion (12) to be fit into the front receptacle (52). A spring (40) is mounted onto the female connector (F) and deforms to spread as the female connector (F) is connected to the male connector (M). The connectors are locked in a properly connected state by a spring force of the spring. Engaging recesses (54) are provided on the outer surface of the male connector (M) and engage with the spring (40). The recesses (54) are recessed inwardly of the outer surface of the front receptacle (52) and are more backward than a connecting bottom surface (53) on a back end of the inner surface of the front receptacle (52).

11 Claims, 22 Drawing Sheets

SPRING LOCK TYPE CONNECTOR

BACKGROUND

1. Field of the Invention

The invention relates to a spring lock connector in which a spring locks male and female connectors in a properly connected state.

2. Description of the Related Art

U.S. Pat. No. 7,588,454 discloses a spring lock type connector assembly. The connector assembly has a male connector with a receptacle, a female connector with a terminal accommodating portion to be fit into the receptacle, and a spring for locking the male and female connectors in a properly connected state. The female connector further includes an outer tube surrounding an outer peripheral side of the terminal accommodating portion. The spring is substantially U-shaped and is fit on the outer peripheral surface of the outer tube. An engaging portion of the spring penetrates through the outer tube and enters the terminal accommodating portion. On the other hand, an engaging projection is formed on the outer peripheral surface of the receptacle of the male connector and is engageable with the engaging portion. The male and female connectors are locked in the properly connected state by the engagement of the engaging portion and the engaging projection.

However, the above-described engaging projection is formed as a projection that projects from the outer peripheral surface of the receptacle. The male connector may be fixed to a body by fitting a hexagon wrench on the outer periphery of the receptacle and tightening a bolt. However, the hexagon wrench and the engaging portion may interfere with each other. An engaging recess may be provided on the outer peripheral surface of the receptacle so as not to project from the outer peripheral surface and the engaging portion engages the engaging recess. However, a part of the receptacle where the engaging recess is formed becomes thinner and strength is reduced.

The invention was completed in view of the above situation and aims to provide an engaging recess engageable with a spring while ensuring the strength of a receptacle.

SUMMARY OF THE INVENTION

The invention relates to a spring lock type connector, comprising a first connector with a receptacle, a second connector with a terminal accommodating portion to be fit into the receptacle and a spring mounted on the second connector. The spring is deformed and spread as the second connector is connected to the first connector. The first and second connectors are locked in a properly connected state by a spring force of the spring. At least one engaging recess is provided on the outer surface of the first connector and is engageable with the spring. The engaging recess is recessed inward of the outer surface of the receptacle and is arranged more backward than a connecting bottom surface located on a back end of the inner surface of the receptacle. The disposition of the engaging recess more backward than the connecting bottom surface of the receptacle ensures that the strength of the receptacle is not reduced by the engaging recess. Further, recessing the engaging recess is inwardly of the outer surface of the receptacle avoids interference of a wrench and the male connector can be avoided when the wrench is fitted on the outer periphery of the receptacle to tighten a bolt.

The terminal accommodating portion preferably is fit on an inner peripheral side of the receptacle.

The male connector may include a male housing with the receptacle and a hexagon nut held on a rear end part of the male housing. The male housing may have a substantially cylindrical outer shape and may be arranged coaxially with the hexagon nut. Thus, the male connector can be fastened to a body by a bolt by fitting a hexagon wrench on the outer periphery of the male housing and tightening the hexagon nut.

At least one engaging projection is provided substantially continuously before the engaging recess in a connecting direction. The engaging projection and the engaging recess cooperate to form a large engaging surface. The spring is engageable with the large engaging surface formed by the engaging projection and the engaging surface, thereby increasing an engaging force.

The spring has at least one engaging portion to be arranged in an entrance path for the receptacle and at least one guide is provided on an opening edge of the receptacle. The engaging portion moves onto the guide if a connecting operation is performed in proper connecting postures. However, part of the opening edge of the receptacle other than the guide contacts the engaging portion and prevents the connecting operation if the connecting operation is performed in improper connecting postures.

At least one guide recess is provided on the outer peripheral surface of the receptacle for guiding the engaging portion in a connecting direction after the engaging portion moves onto the guide. Two of the engaging portions preferably are provided at opposite sides of the receptacle, two of the guide recesses are provided on substantially opposite sides of the receptacle substantially in correspondence with the engaging portions. Separation of the spring from the second connector is suppressed when engaging portions are engaged with the guide recesses.

The spring preferably has two lateral legs that are deformable to spread as the second connector is connected to the first connector. The first and second connectors are locked in a properly connected state by a spring force of the spring. The second connector preferably has a lock arm capable of releasing locking by lifting up the spring. Two lateral protection walls are arranged at substantially opposite lateral sides of the lock arm. Two lateral resilient pieces extend in substantially forward and backward directions between the lock arm and the protection walls and coupling the lock arm and the protection walls. Two lateral displacement preventing walls are provided at an interval narrower than the protection walls and below the protection walls. A rear end part of the lock arm is to be fit into a clearance between the displacement preventing walls together with the resilient pieces when the lock arm is unlocked, thereby preventing lateral displacements of the lock arm.

The protection walls preferably are provided continuously on the outer edges of the displacement preventing walls, and two lateral supporting protrusions are provided below the lock arm in the second connector for supporting the lock arm at two points. Two lateral supporting recesses are provided on the lower surface of the lock arm and individually receive the supporting protrusions when the lock arm is unlocked. The second connector includes an escaping portion for allowing the rear part of the lock arm to escape when the lock arm is unlocked. Each supporting protrusion preferably has a front inclined surface and a rear inclined surface. The front inclined surface is sloped more moderately downward than the rear inclined surface.

These and other objects, features and advantages of the invention will become more apparent upon reading the following detailed description of a preferred embodiment and accompanying drawings.

DETAILED DESCRIPTION OF THE PREFERRED EMBODIMENTS

Figure 1:
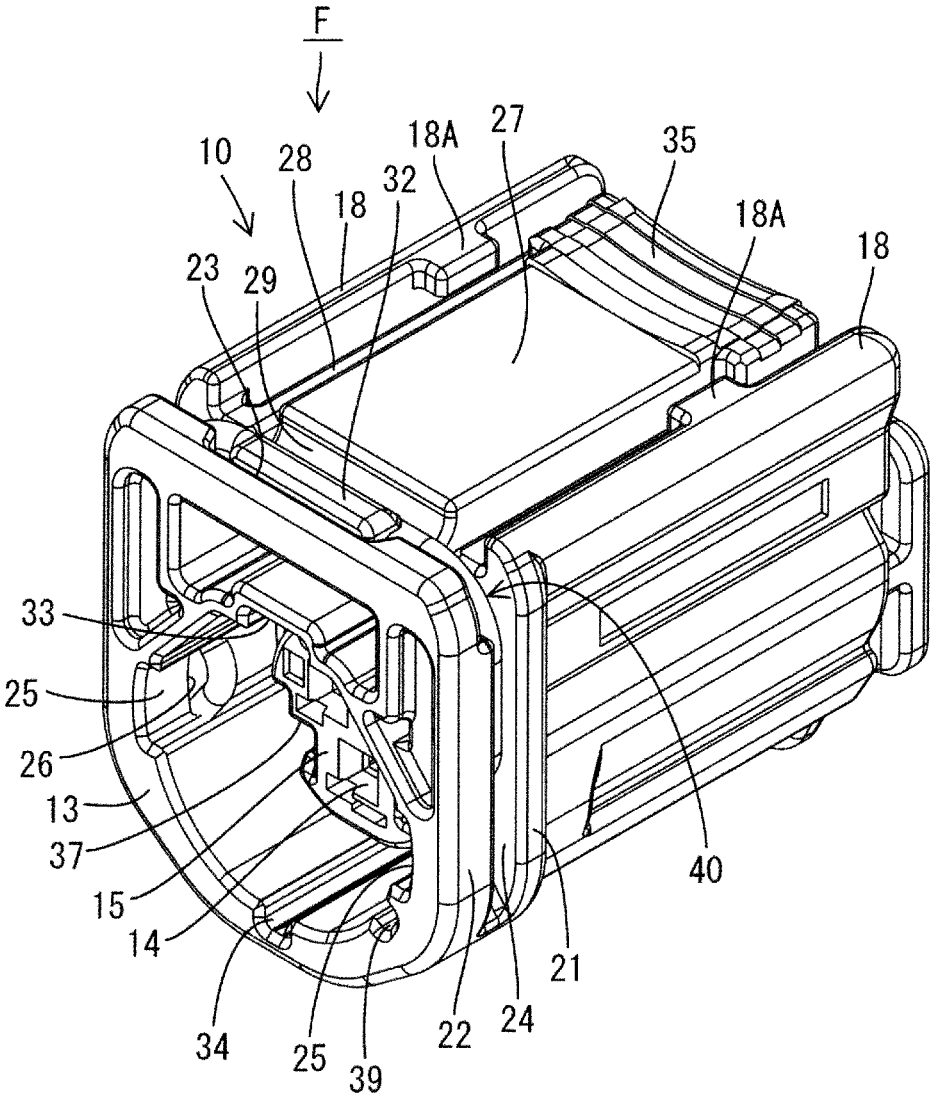
FIG. 1 is a perspective view of a female connector.
Figure 19:
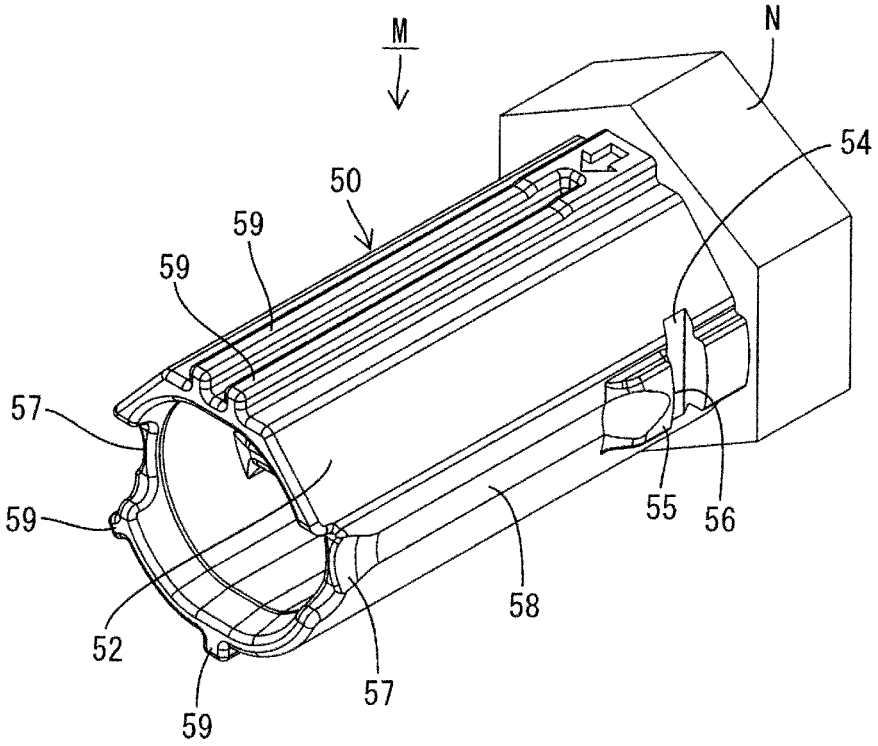
FIG. 19 is a perspective view of the male connector.

A spring lock connector in accordance with this embodiment has a female connector F shown in FIG. 1 and a male connector M shown in FIG. 19. The female connector F has a female housing 10 that can be connected to a male housing 50 of the male connector M. A spring 40 is mounted on the female housing 10 and locks the connectors F, M in a properly connected state. In the following description, forward and backward directions are based on a connecting direction of the two connectors F, M and connecting ends thereof are referred to as front ends. Further, vertical and lateral directions are based on FIGS. 2 and 20.

Figure 20:
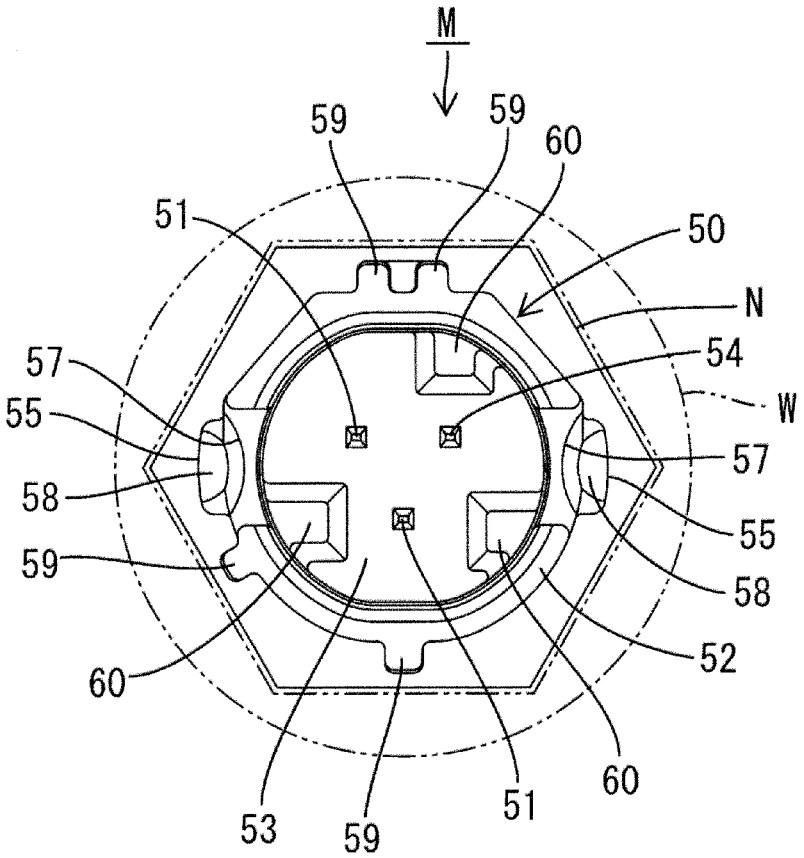
FIG. 20 is a front view showing a state where the male connector is inserted in a hexagon wrench.
Figure 21:
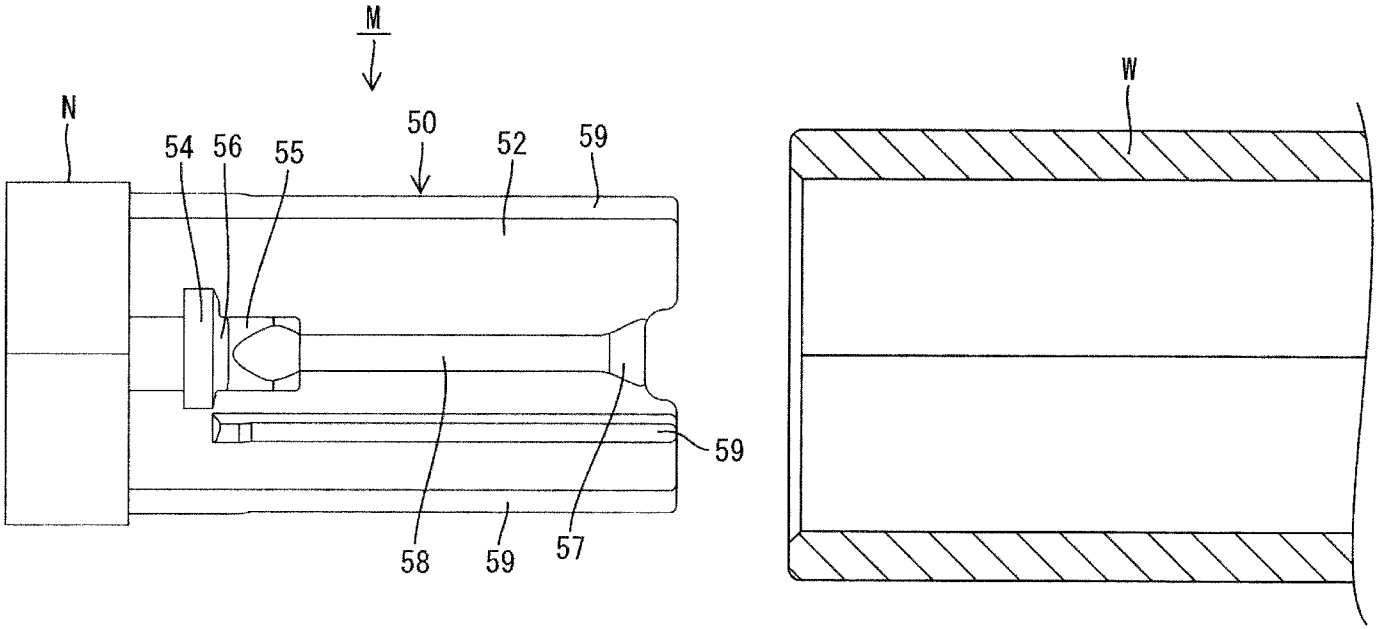
FIG. 21 is a side view showing a state before the male connector is inserted into the hexagon wrench.
Figure 22:
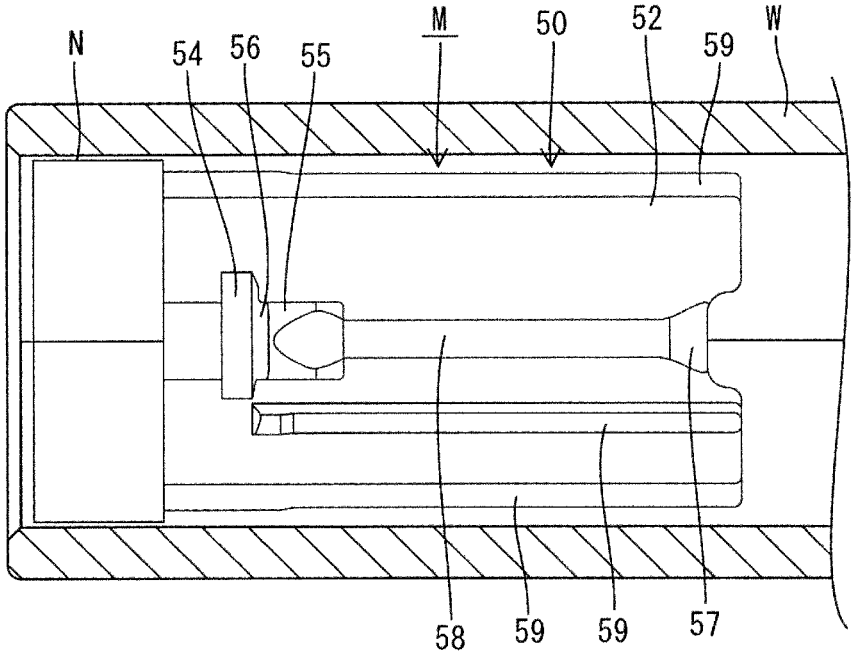
FIG. 22 is a side view showing a state where the male connector is inserted in the hexagon wrench.

The male housing 50 made of synthetic resin and, as shown in FIG. 19 a hexagon nut N is held on a rear end of the male housing 50. As shown in FIG. 20, the male housing 50 has a substantially circular outer shape and is substantially coaxial with the hexagon nut N. Further, the male housing 50 does not bulge out from the outer shape of the hexagon nut N so that the male housing 50 can be inserted into a hexagon wrench W without interference, as shown in FIGS. 21 and 22. Thus, the hexagon wrench W can be used to tighten and fix the male connector M to a highly vibrating member (not shown) such as an engine.

Figure 5:
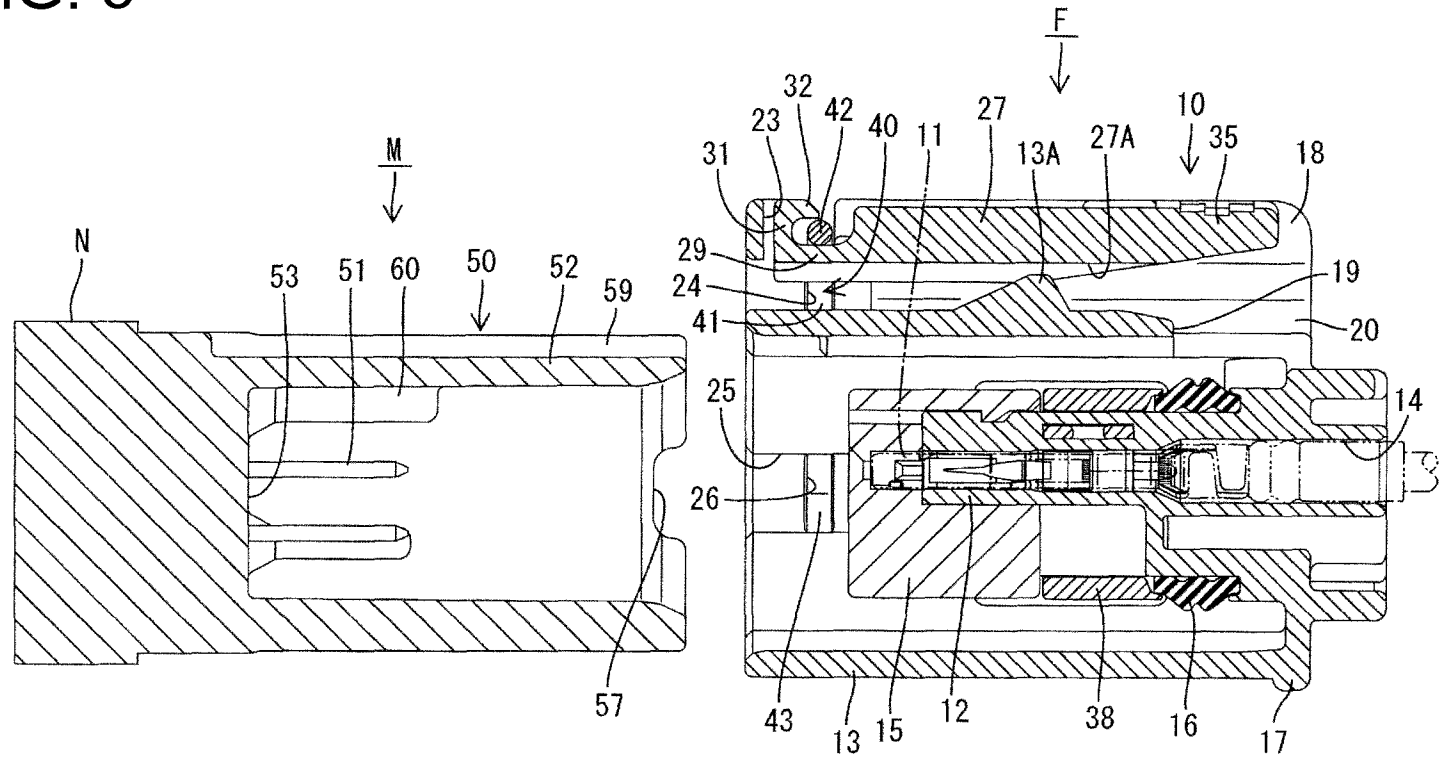
FIG. 5 is a side view in section showing a state before a male connector and the female connector are connected.

The male housing 50 has a forwardly open substantially cylindrical front receptacle 52, as shown in FIG. 19, and a rear receptacle (not shown) that opens backward. The rear receptacle is integral to the hexagon nut N. A connecting bottom surface 53 is formed on a back bottom end part of the inner surface of the front receptacle 52, and the front receptacle 52 projects from the periphery of the connecting bottom surface 53. As shown in FIG. 5, male terminals 51 are press-fit and held on the back wall of the male housing 50 and penetrate in forward and backward directions. The male terminals 51 project forward from the connecting bottom surface 53, and the front end positions thereof are at an intermediate position of the front receptacle 52 in forward and backward directions. Note that three male terminals 51 are arranged in an inverted triangle, as shown in FIG. 20.

Figure 15:
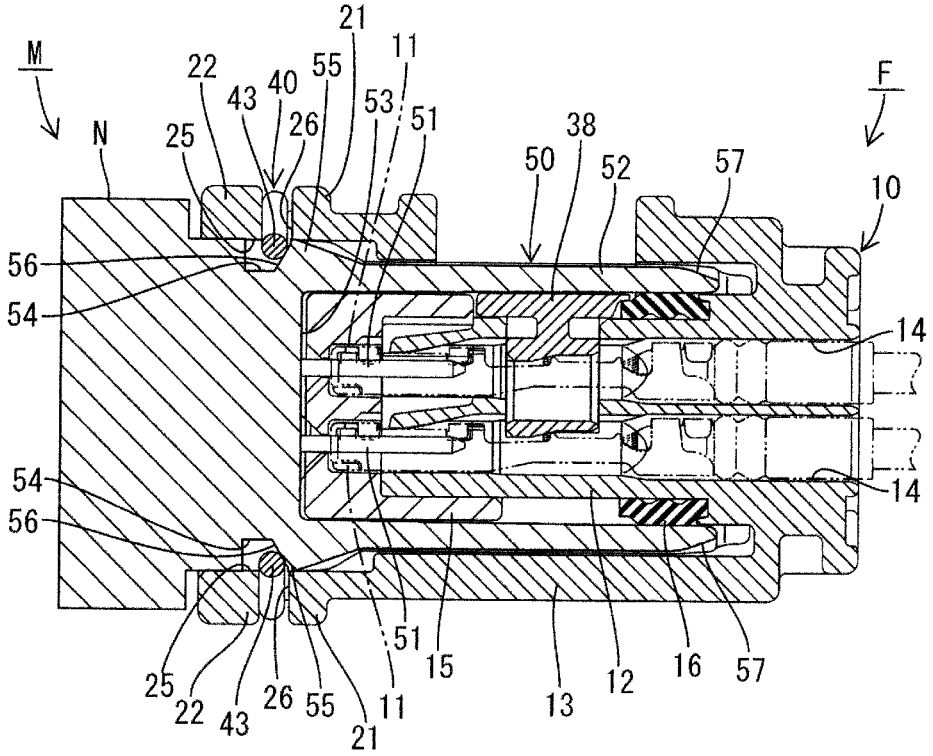
FIG. 15 is a plan view in section showing a state where the male connector and the female connector are locked in the properly connected state.

Left and right engaging projections 55 project laterally from opposite lateral side surfaces of the male housing 50, as shown in FIG. 15. The engaging projections 55 are provided continuously before left and right engaging recesses 54 formed on opposite left and right side surfaces of the male housing 50. The engaging projections 55 are arranged at substantially the same position as the connecting bottom surface 53 in forward and backward directions and are at positions substantially facing each other in the lateral direction on the outer peripheral surface of the male housing 50, as shown in FIG. 20.

As shown in FIG. 15, each engaging recess 54 has front and rear surfaces and a bottom surface arranged between the front and rear surfaces and extending in forward and backward directions. The bottom surface is inward of the outer peripheral surface of the front receptacle 52. The engaging recesses 54 are rearward of the connecting bottom surface 53. Thus, a distance of the engaging recesses 54 from the distal end of the front receptacle 52 exceeds a distance of the connecting bottom surface 53 from the distal end of the front receptacle 52. The front surface of each engaging projection 55 is inclined moderately out from the front side toward the back side so that the spring 40 can easily move thereon, and the rear surface thereof forms part of an engaging surface 56 with which the spring 40 is engageable. A remaining part of the engaging surface 56 is formed by the front surface of the engaging recess 54. In other words, the engaging surface 56 is formed by a rear inclined surface of the engaging projection 55 and a front inclined surface of the engaging recess 54. Specifically, the rear inclined surface of the engaging projection 55 also is behind the connecting bottom surface 53.

The female housing 10 is molded from a synthetic resin to include a terminal accommodating portion 12 and an outer tube 13 arranged at an outer peripheral side of the terminal accommodating portion 12, as shown in FIG. 5. The terminal accommodating portion 12 is substantially cylindrical and can fit into the front receptacle 52 of the male housing 50. This terminal accommodating portion 12 is formed with three cavities 14 into which the female terminals 11 are inserted from behind. The cavities 14 are arranged in an inverted triangle in conformity with the arrangement of the male terminals 51. A front cap 15 is fit on a front end part of the terminal accommodating portion 12.

Figure 6:
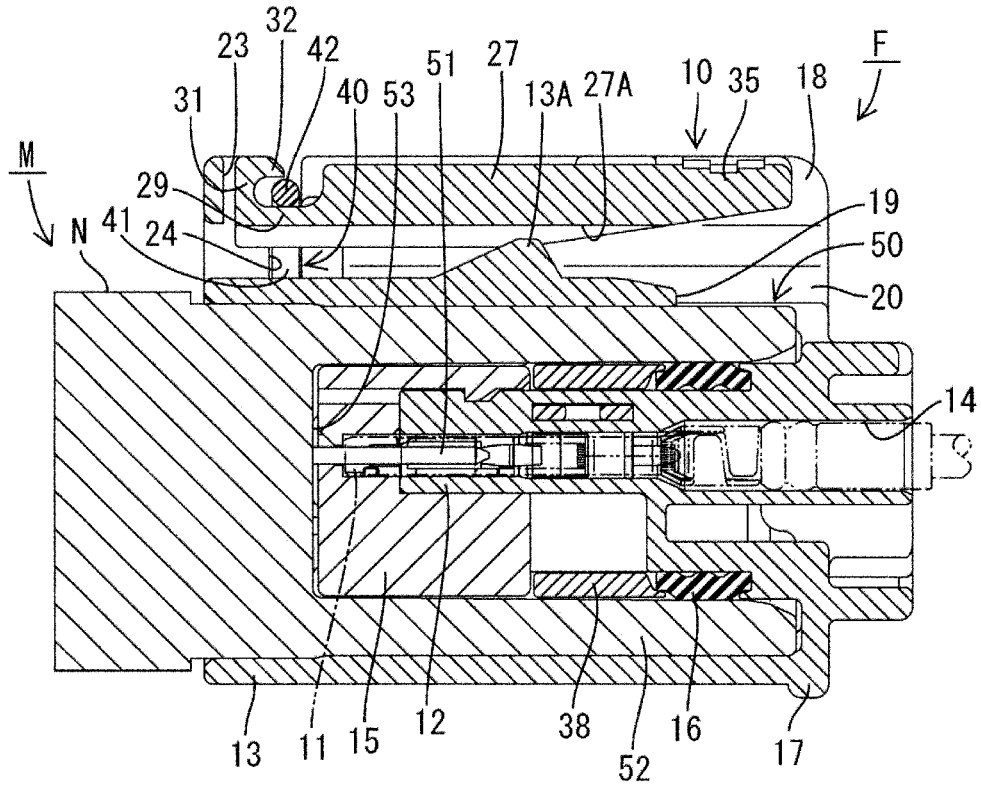
FIG. 6 is a side view in section showing a state where the male connector and the female connector are locked in a properly connected state.
Figure 7:
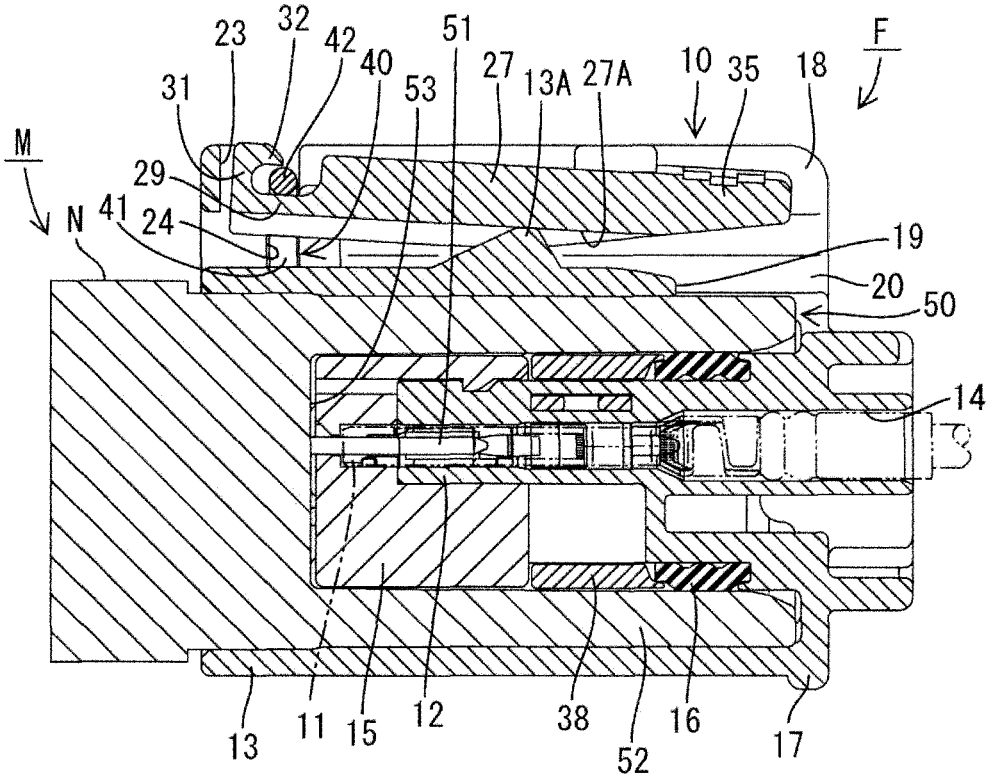
FIG. 7 is a side view in section showing a state where a supporting projection is received into a supporting recess to be supported as a lock arm is unlocked.

The outer tube 13 is substantially cylindrical and extends from the rear end of the terminal accommodating portion 12 to a position beyond the front end of the terminal accommodating portion 12. Rear ends of the outer tube portion 13 and the terminal accommodating portion 12 are coupled to each other. An entrance path is formed between the outer tube 13 and the terminal accommodating portion 12 for receiving the front receptacle 52 of the male housing 50. A seal ring 16 is fit externally on a back part of the outer peripheral surface of the terminal accommodating portion 12 and is sandwiched between the front receptacle 52 of the male housing 50 and the terminal accommodating portion 12 of the female housing 10 to providing sealing between the male and female housings 50, 10, as shown in FIG. 6. An opening is formed in a side wall of the outer tube 13 to mount a retainer 38 for retaining the female terminals 11 in the terminal accommodating portion 12.

A finger hooking portion 17 projects down from the lower surface of a rear end part of the female housing 10. An index finger can be hooked on the finger hooking portion 17 to separate the connectors F, M, as explained below.

Left and right protection walls 18 are provided on the upper surface of the outer tube 13 and extend in forward and backward directions, as shown in FIG. 1. The protection walls 18 extend continuously from the rear end of the female housing 10 to a position near the front end, and a lock arm 27 is provided between the protection walls 18.

A part of the upper surface of the outer tube 13 between the protection walls 18 is cut from an intermediate position in forward and backward directions to the rear end, thereby forming an escaping portion 19, as shown in FIG. 5. The escaping portion 19 is more inward than the unlocking portion 35 of the lock arm 27 and has a height position more inward than the upper surface of the outer tube 13. Thus, the unlocking portion 35 can be pushed to the position of the escaping portion 19.

Figure 4:
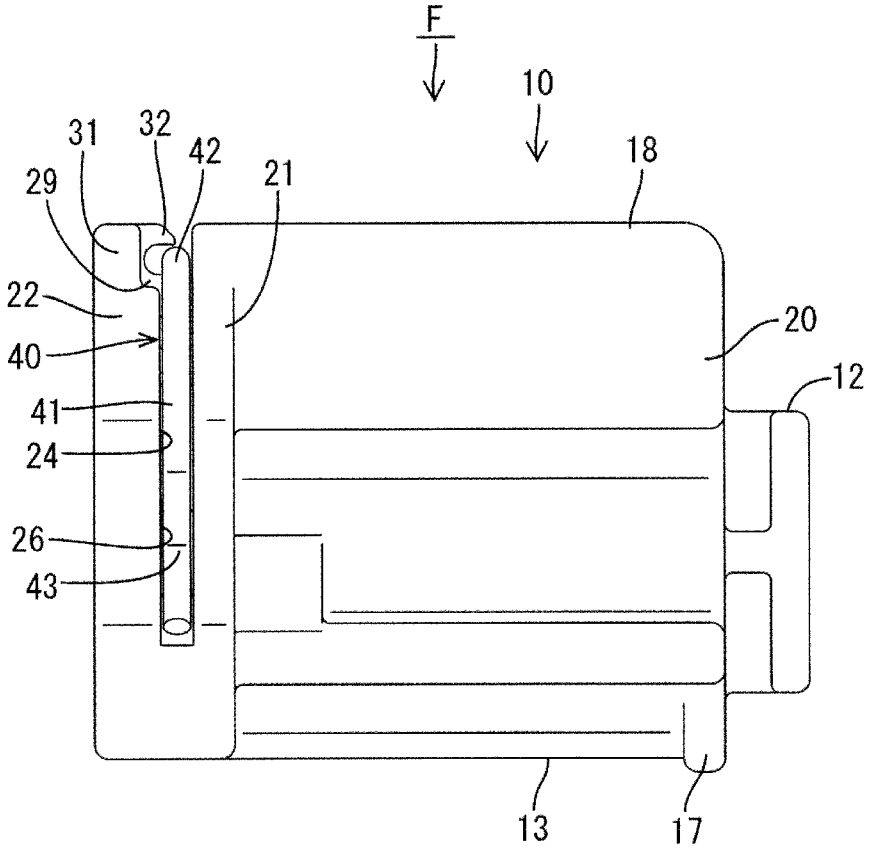
FIG. 4 is a right side view of the female connector.

A first positioning wall 21 is provided on the outer peripheral surface the outer tube 13 at a position slightly rearward of the front end and a second positioning wall 22 is provided on the outer peripheral surface the outer tube 13 at a position spaced forward from the first positioning wall 22, as shown in FIG. 1. The first positioning wall 21 defines ribs extending down from front ends of the protection walls 18 along the opposite side surfaces of the outer tube 13. On the other hand, the second positioning wall 22 defines a U-shaped rib extending from the upper surface to the opposite side surfaces of the outer tube 13. The first and second positioning walls 21 and 22 are substantially parallel and are spaced apart in forward and backward directions by a distance substantially equal to a diameter of the spring 40, as shown in FIG. 4.

Figure 3:
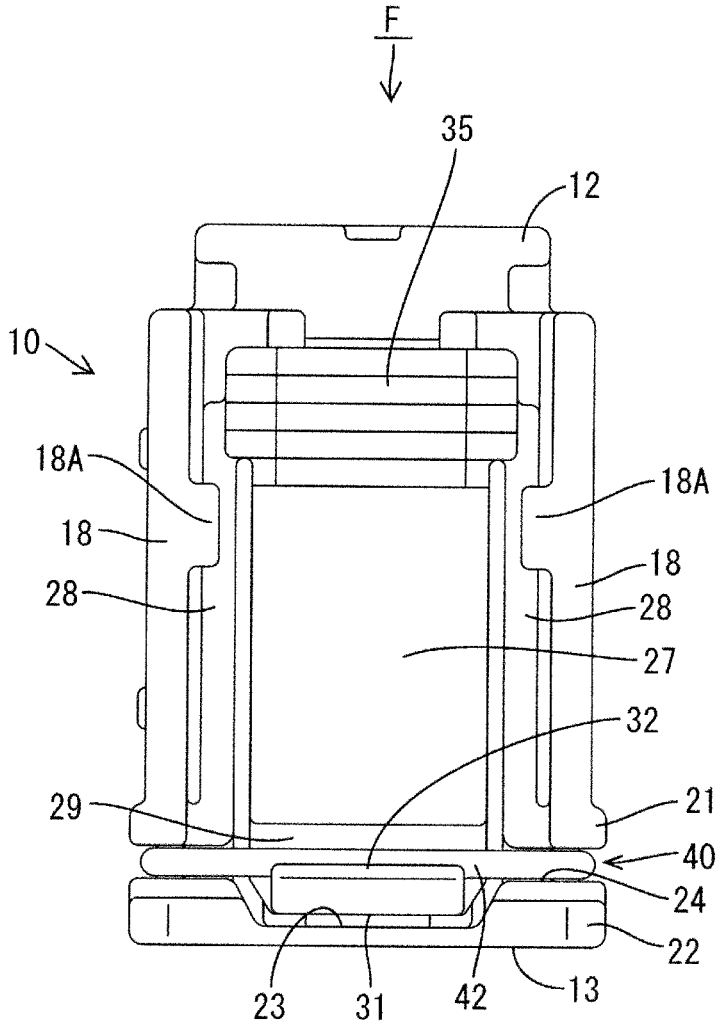
FIG. 3 is a plan view of the female connector.

A front recess 23 is formed in a widthwise intermediate part of the second positioning wall 22 at a position to receive a front end part of the lock arm 27. The depth of the front recess 23 gradually increases from opposite widthwise ends toward a central part, and the depth of the central part is more than half the thickness of the second positioning wall 22 in forward and backward directions as shown in FIG. 3.

A mounting portion 24 is defined on a part of the outer tube 13 between the first and second positioning walls 21, 22 and can receive the spring 40. The mounting portion 24 is defined by the first and second positioning walls 21, 22 and an inward recess on the outer peripheral surface of the outer tube 13.

Figure 2:
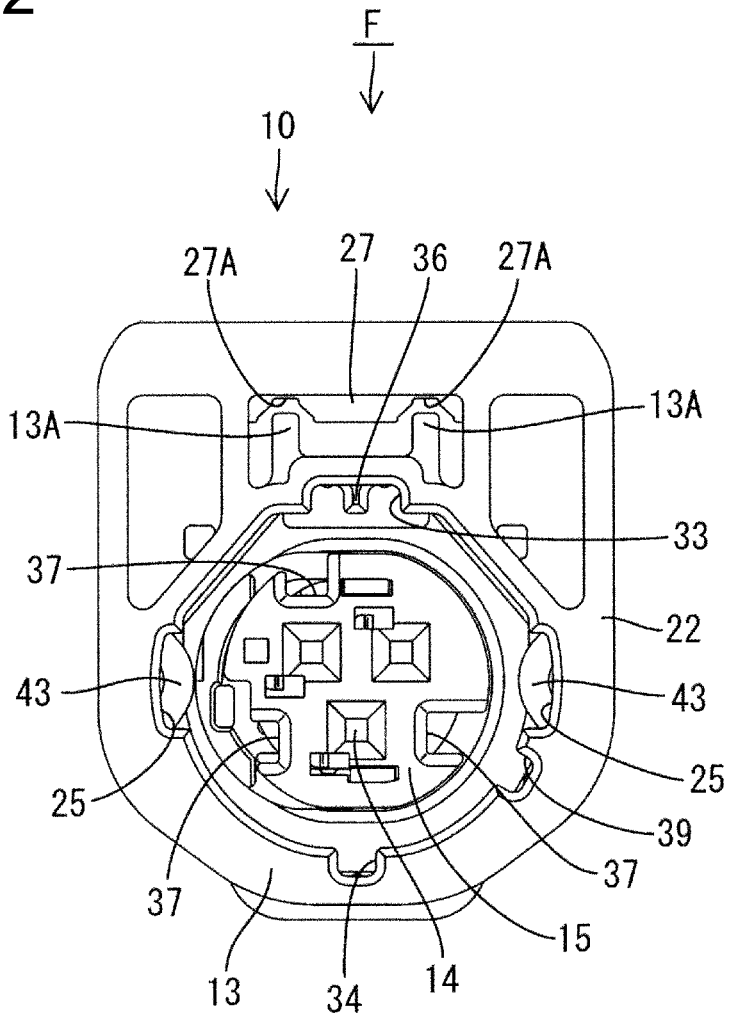
FIG. 2 is a front view of the female connector.

Passage paths 25 are provided on left and right side walls of the outer tube 13, as shown in FIG. 2, and can receive the engaging projections 55 of the male housing 50. The passage paths 25 extend back from the front end of the outer tube 13 and communicate with the mounting portion 24 at communicating portions 26. A vertical dimension of the communicating portions 26 is substantially equal to that of the engaging projections 55, as shown in FIG. 13.

Figure 11:
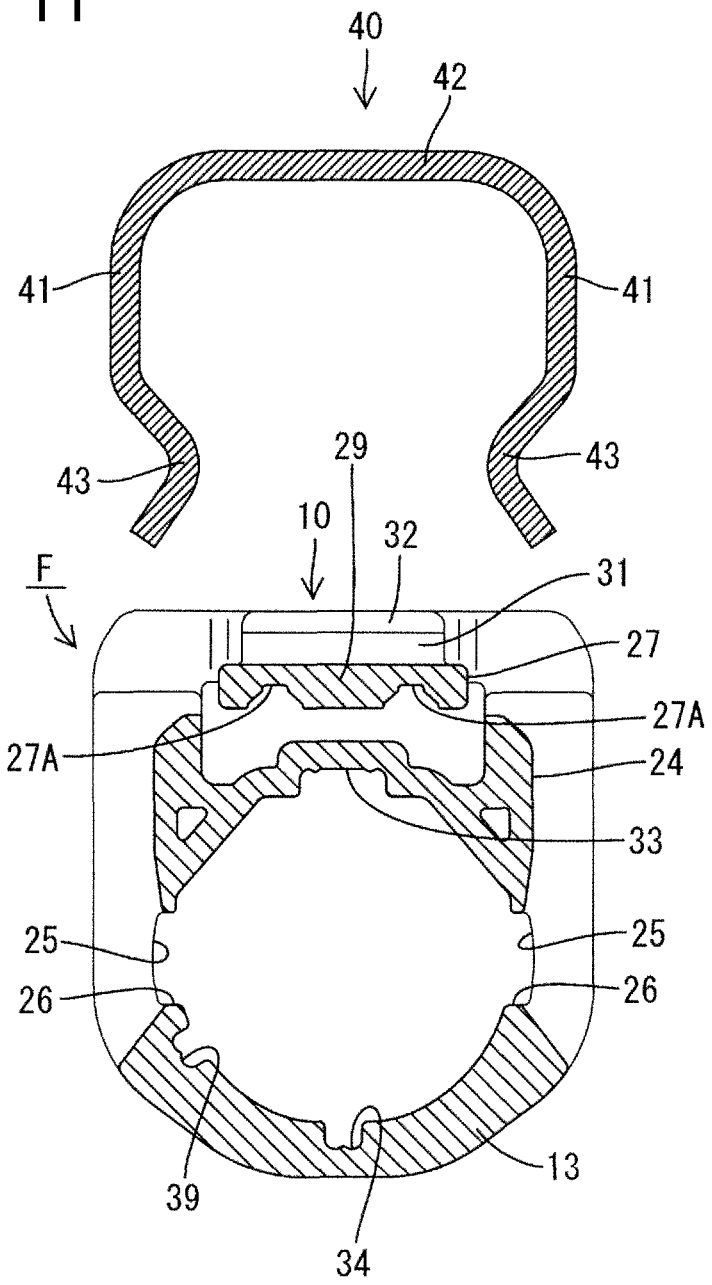
FIG. 11 is a front view in section showing the state before the spring is mounted onto the female connector.

As shown in FIG. 11, the spring 40 has left and right legs 41 and an upper side 42 that couples upper ends of the legs 41 to define a substantially U shape that opens down in a mounting direction intersecting a connecting direction of the male and female connectors M, F. The legs 41 hang vertically down from opposite ends of the upper side 42 when in a natural state, but are resiliently deformable in mutually facing directions.

Distal end parts of the legs 41 are bent in toward each other to define mountain-shaped engaging portions 43 that bulge into the entrance path for the front receptacle 52 across the passage paths 25. Each engaging portion 43 has an upper inclined side and a lower inclined side that approach each other toward an inner side, and a coupling of the upper and lower inclined sides is rounded.

Figure 12:
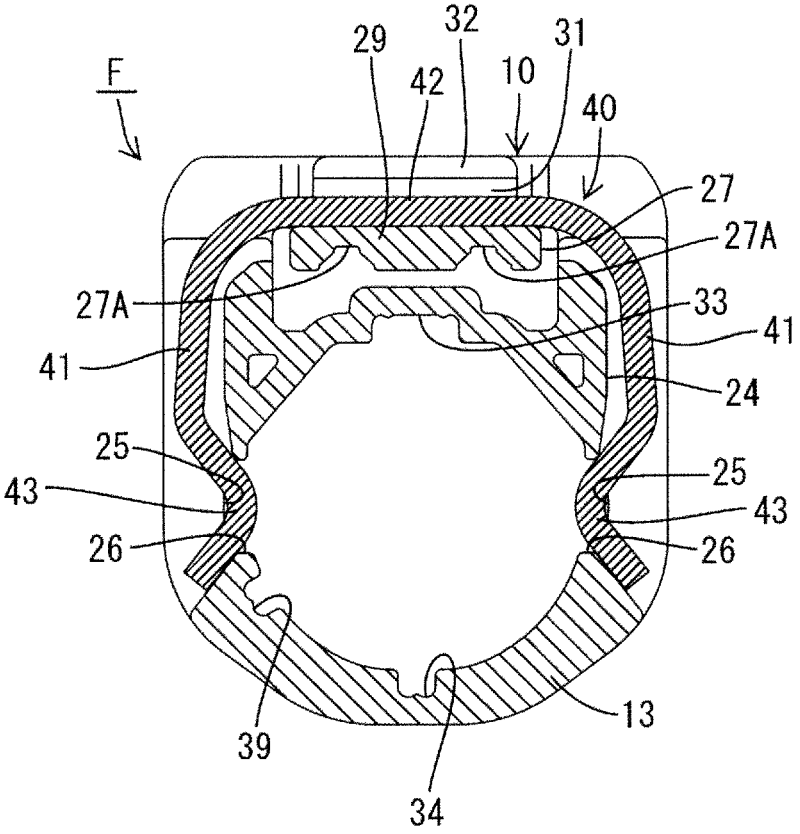
FIG. 12 is a front view in section showing the state before the spring is mounted onto the female connector.
Figure 13:
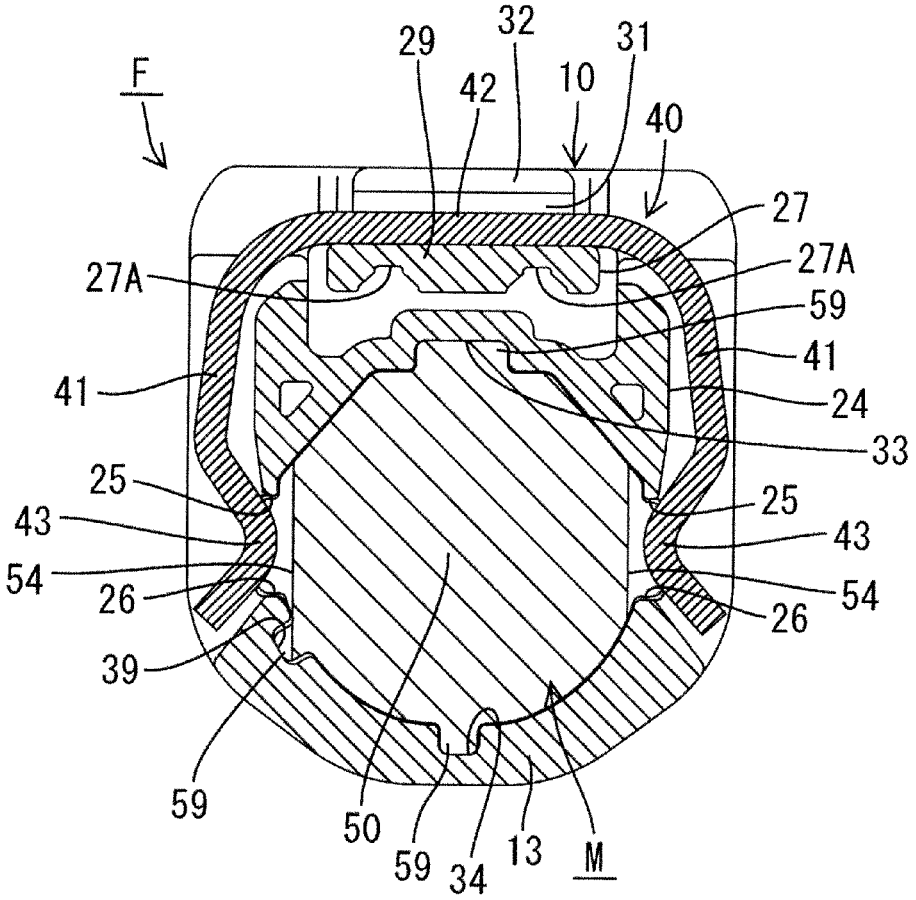
FIG. 13 is a front view in section showing the state where the male connector and the female connector are locked in the properly connected state.
Figure 14:
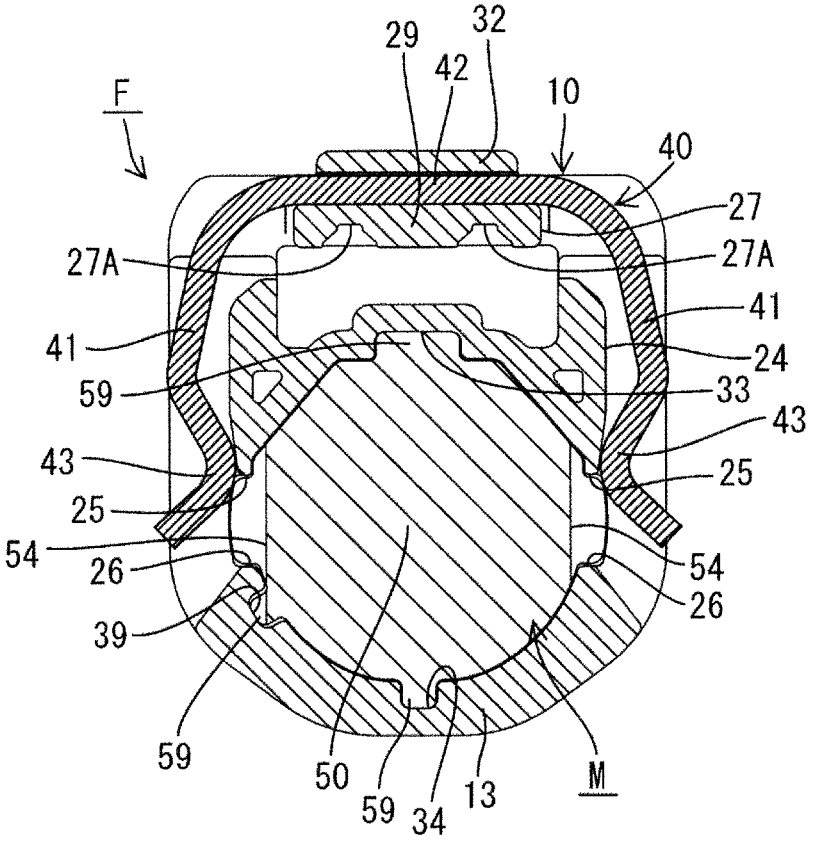
FIG. 14 is a front view in section showing a state where locking is released as the lock arm is unlocked.

The spring 40 is displaceable between: an initial position where the engaging portions 43 bulge across the passage paths 25 and into the entrance path for the front receptacle 52, as shown in FIG. 12; an entrance position where the engaging portions 43 bulge into the passage paths 25, as shown in FIG. 13; and a retracted position where the engaging portions 43 are retracted from the passage paths 25, as shown in FIG. 14. The engaging portions 43 bulge into the passage paths 25 when the spring 40 is at the entrance position, but the legs 41 are pushed by the engaging projections 55 passing along the passage paths 25 and deform resiliently out. The legs 41 resiliently return when the connectors F, M reach a properly connected state, and the engaging portions 43 engage the engaging surfaces 56, as shown in FIG. 15, to lock the male housing 50 inseparably. The spring 40 reaches the retracted position by being displaced up in a direction opposite the mounting direction and in a direction away from the female housing 10 from the entrance position. The engaging portions 43 are retracted from the passage paths 25 and release locking when the spring 40 reaches the retracted position. The engaging portions 43 retracted from the passage paths 26 move onto parts of the mounting portion 24 above the communicating portions 26.

Guides 57 are provided on an opening edge of the front receptacle 52, as shown in FIG. 19, and move onto the engaging portions 43 when a connecting operation is performed in proper connecting postures. However, parts of the opening edge of the front receptacle 52 other than the guides 57 contact the engaging portions 43 to prevent the connecting operation when the connecting operation is performed in improper connecting postures. The guides 57 are substantially U-shaped cuts on the opening edge of the front receptacle 52 and slant along the outer surface of the front receptacle 52 from the peripheral edge of the cut toward the back. Two guides 57 are provided on opposite left and right sides of the front receptacle 52 in correspondence with the left and right engaging portions 43.

Guide recesses 58 are provided on the outer peripheral surface of the front receptacle 52 for guiding the engaging portions 43 to the engaging surfaces 56 in a connecting direction after the engaging portions 43 move onto the guiding portions 57 particularly. The guide recesses 58 are provided on the opposite left and right sides of the front receptacle 52, in correspondence with the left and right engaging portions 43 and in ranges from the guiding portions 57 to the front inclined surfaces of the engaging projections 55. The spring 40 is prevented from being separated up from the female connector F when the left and right engaging portions 43 are engaged with the left and right guide recesses 58.

As shown in FIG. 3, the lock arm 27 extends in forward and backward directions and is coupled to the left and right protection walls 18 via left and right resilient pieces 28 provided on opposite lateral sides. The unlocking portion 35 is provided on the rear end part of the lock arm 27 and is used to push down the rear end part of the lock arm 27 by a thumb. The lock arm 27 has a projecting length from the rear end of the female housing 10 to the front recess 23 of the second positioning wall 22.

The resilient pieces 28 extend in forward and backward directions with front ends of the resilient pieces 28 coupled to the protection walls 18 and rear ends coupled to the unlocking portion 35 of the lock arm 27. The resilient pieces 28 support the lock arm 27 so that the unbiased lock arm 27 is substantially parallel to and spaced out from the outer surface of the outer tube 13.

Figure 16:
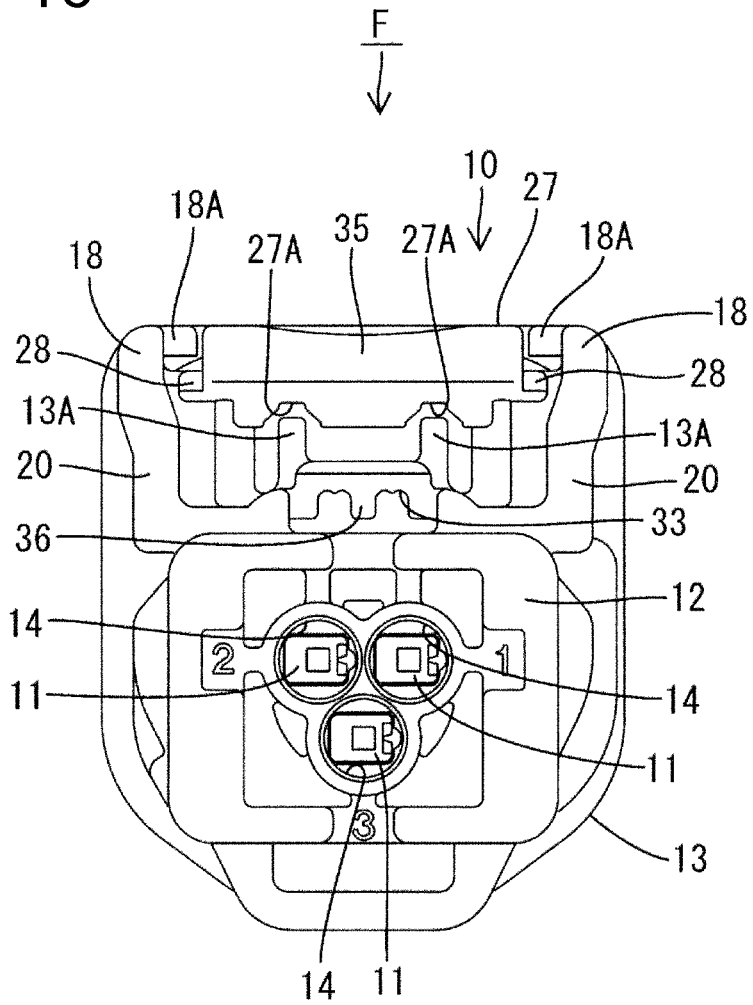
FIG. 16 is a rear view of the female connector.
Figure 17:
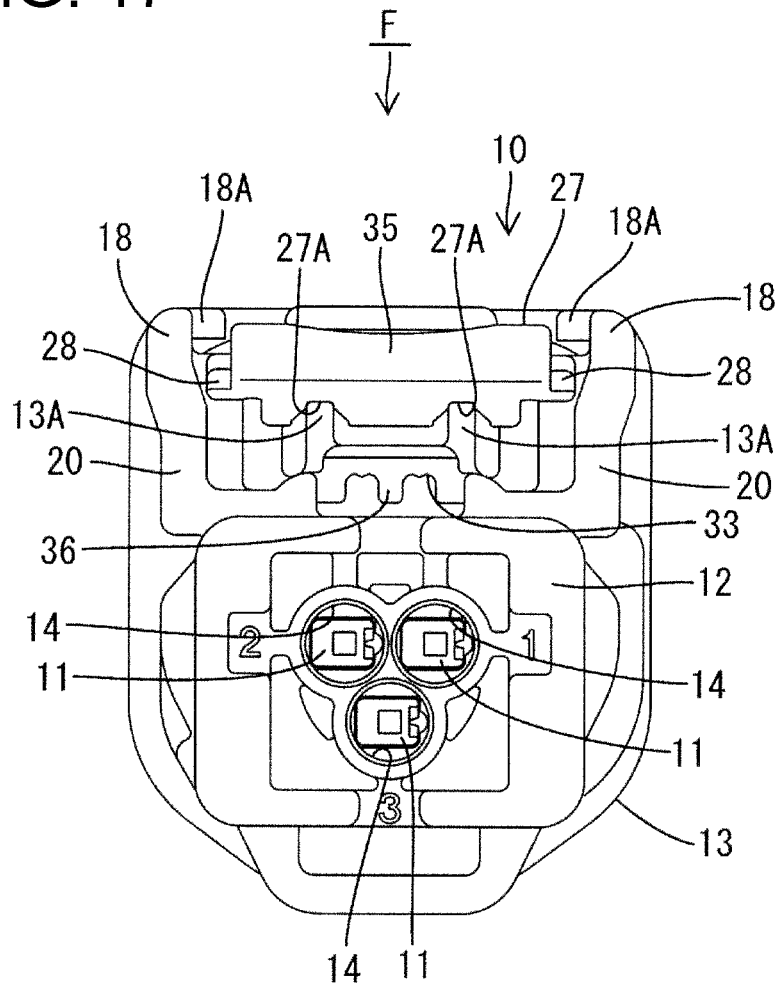
FIG. 17 is a rear view showing the state where the supporting projection is received into the supporting recess to be supported as the lock arm is unlocked.

As shown in FIG. 16, left and right supporting protrusions 13A are provided in the outer tube 13 below the lock arm 27 for supporting the lock arm 27 in a horizontal posture. Left and right supporting recesses 27A are provided on the lower surface of the lock arm 27 and receive the supporting protrusions 13A when the lock arm 27 is unlocked. The supporting protrusions 13A contact the supporting recesses 27A when the unlocking portion 35 of the lock arm 27 is pushed down, as shown in FIG. 17. The lock arm 27 is displaced pivotally like a seesaw with the supporting protrusions 13A as supports when the unlocking portion 35 is pushed further down. Associated with this, the resilient pieces 28 are deformed resiliently. Each supporting protrusion 13A has a front inclined surface and a rear inclined surface that is sloped more steeply down than the front inclined surface.

Left and right turn preventing pieces 18A project in toward each other from upper edges of the protection walls 18. The turn preventing pieces 18A are above the resilient pieces 28. Thus, the resilient pieces 28 contact the turn preventing pieces 18A from below when the lock arm 27 is pushed up or out by an external force and hence the turn preventing pieces 18A prevent the lock arm 27 from being turned.

Left and right displacement preventing walls 20 are formed on the opposite lateral edges of the upper surface of the outer tube 13 at an interval narrower than the interval of the left and right protection walls 18. The protection walls 18 are provided substantially continuously on the upper edges of the displacement preventing walls 20. The unlocking portion 35 of the lock arm 27 and the rear end parts of the resilient pieces 28 connected to the unlocking portion 35 fit into a clearance between the displacement preventing walls 20 as the lock arm 27 is unlocked to prevent lateral displacements of the lock arm 27.

The front end of the lock arm 27 is arranged below the spring 40 and serves as a pushing portion 29 for pushing the spring 40 up in the direction substantially opposite to the mounting direction when the lock arm 27 is inclined. A front wall 31 is provided on the front part of the lock arm 27 and projects up. The pushing portion 29 has a downwardly concave recess that recessed toward a side toward which the spring 40 is pressed when the front wall 31 pushes the spring 40 up. The front wall 31 is fit into the front recess 23 of the second positioning wall 22 and, the rear surface thereof and the rear surface of the second positioning wall 22 are substantially flush when the lock arm 27 is in the natural state. The front wall 31 has a width substantially equal to the width of the lock arm 27.

Figure 8:
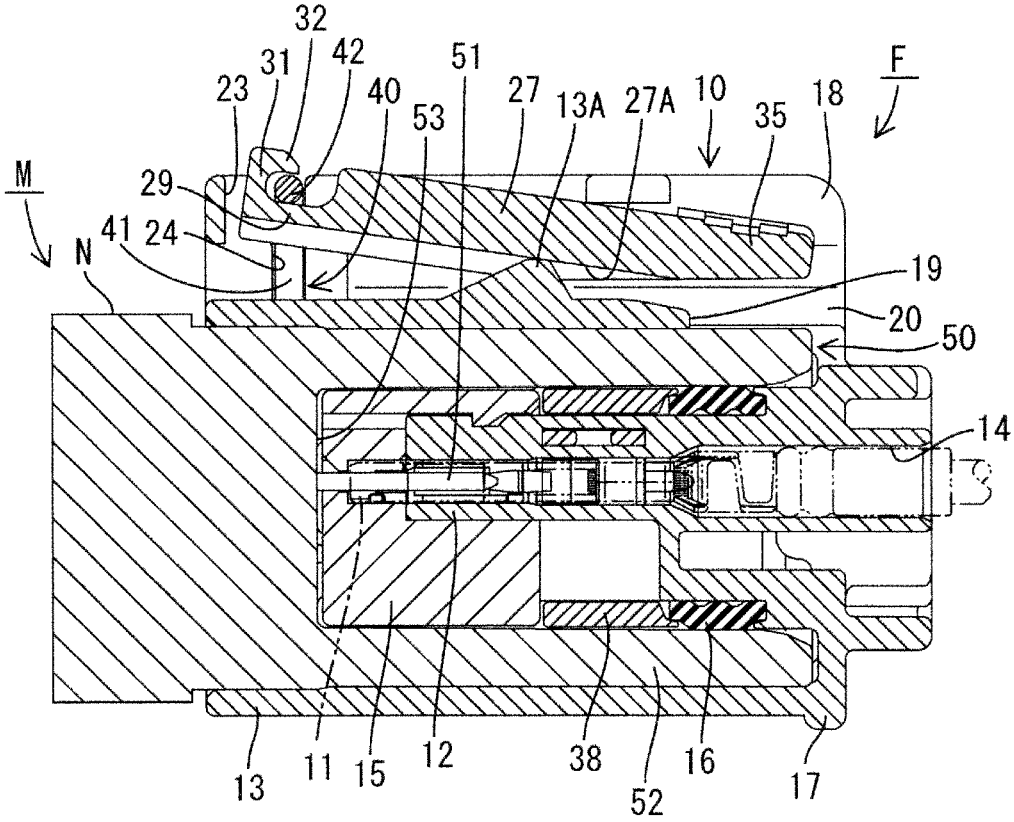
FIG. 8 is a side view in section showing a state where a spring is lifted up as the lock arm is unlocked.
Figure 9:
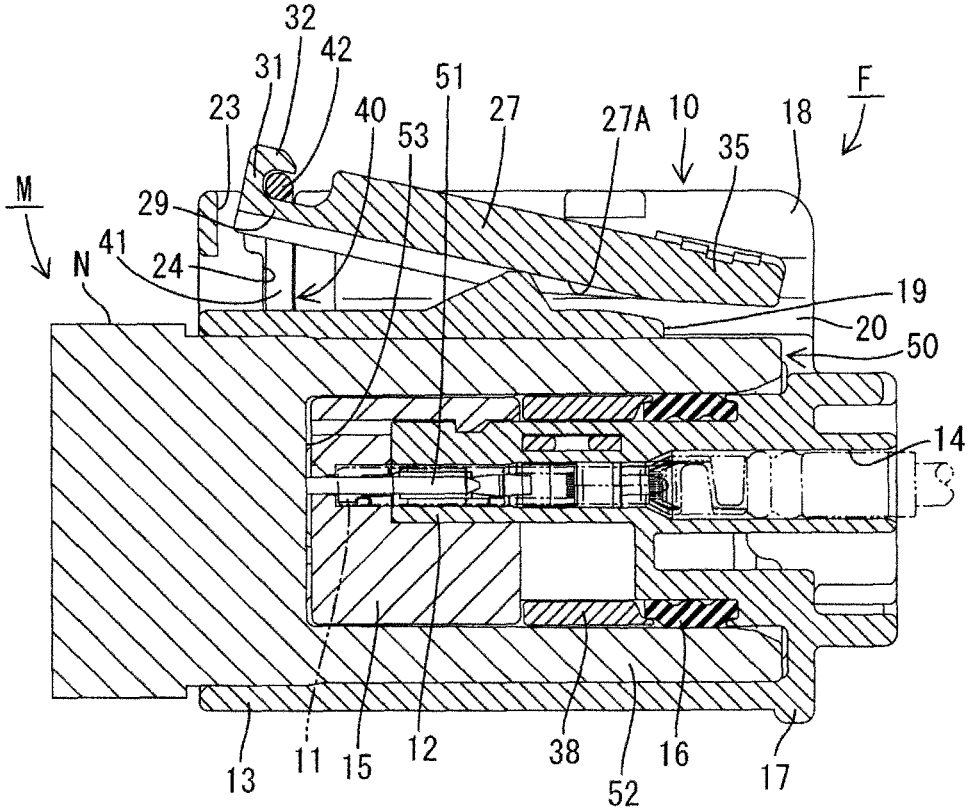
FIG. 9 is a side view in section showing a state where a rear end part of the lock arm is pushed more downward than in a state of FIG. 8 by being allowed to escape into an escaping portion.
Figure 10:
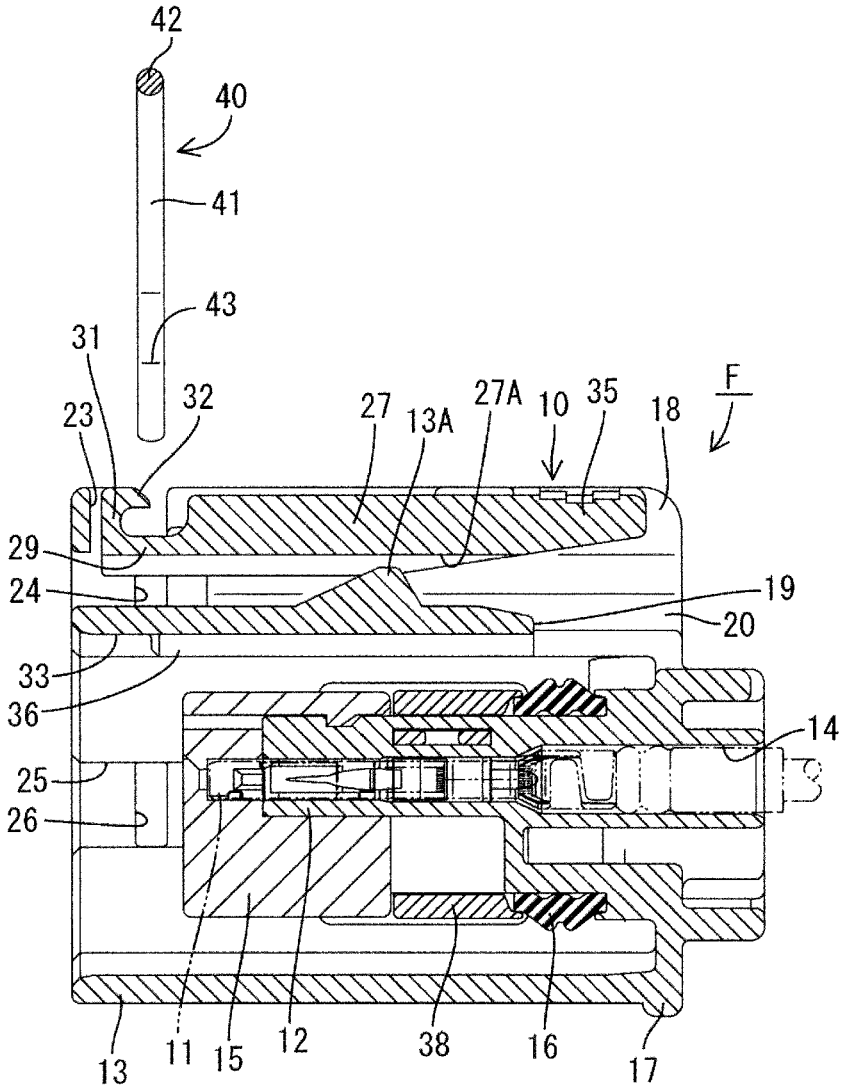
FIG. 10 is a side view in section showing a state before the spring is mounted onto the female connector.

A bulge 32 is provided on the upper end of the front wall 31 and projects back. A projecting distance of the bulge 32 is substantially equal to the diameter of the spring 40. However, the bulge 32 is slightly before the upper side 42 of the spring 40 when the spring 40 is at the entrance position shown in FIG. 6. Thus, a dimension of a part of the bulge 32 covering the upper side 42 of the spring 40 is substantially equal to a dimension (radius) that is substantially half the dimension (diameter) of the spring 40 in forward and backward directions. On the other hand, the bulge 32 is slightly behind the upper side 42 of the spring 40 when the spring 40 is at the retracted position shown in FIG. 8. Thus, the upper side 42 of the spring 40 is substantially entirely covered by the bulge 32.

The front receptacle 52 has a substantially cylindrical shape, and thus is more likely to be fit erroneously into the female housing 10. Error fitting preventing mechanisms are provided to prevent erroneous fitting and include outer ribs 59, the spring 40 and inner ribs 60. Specifically, the error fitting preventing mechanism is started by the outer ribs 59, then by the spring 40 and finally by the inner ribs 60.

As shown in FIG. 19, two outer ribs 59 are provided on an upper part of the outer peripheral surface of the front receptacle 52, one outer rib 59 is provided on a lower part and one outer rib 59 is provided below the left guide 57. Each outer rib 59 extends in forward and backward directions. As shown in FIGS. 13 and 19, the two outer ribs 59 on the upper side are united into one outer rib 59 at a position in forward and backward directions substantially where the engaging recesses 54 are provided. On the other hand, the inner peripheral surface of the outer tube 13 of the female housing 10 has an upper guide recess 33 that collectively accommodates the two upper outer ribs 59, a lower guide recess 34 that accommodates the lower outer rib 59 and a right lower guide recess 39 that accommodates the remaining one outer rib 59, as shown in FIG. 2. An intermediate rib 36 is provided on the upper surface of the upper guide recess 33 and can be fit between the upper two outer ribs 59. The intermediate rib 36 extends back from a position slightly behind the front edge of the front receptacle 52.

As shown in FIG. 20, one inner rib 60 is provided substantially at a one left lower position, one inner rib 60 is provided substantially at a right upper position and one inner rib 60 is provided at a right lower position on the inner peripheral surface of the front receptacle 52. Each inner rib 60 extends forward from the connecting bottom surface 53. The inner rib 60 at the left lower position is longer in forward and backward directions than the other two inner ribs 60. On the other hand, as shown in FIG. 2, three error fitting preventing recesses 37 for accommodating the three inner ribs 60 are provided on the outer peripheral surface of the front cap 15 of the female housing 10.

As shown in FIG. 2, the error fitting preventing mechanism defined by the spring 40 utilizes the engaging portions 43 that are located in the entrance path for the front receptacle 52 across the passage paths 25, and prevents error fitting by the contact of parts of the front end of the front receptacle 52 other than the guides 57 with the engaging portions 43.

With the above-described design, even if the outer ribs 59 do prevent error fitting, the parts of the front end of the front receptacle 52 other than the guides 57 contact the engaging portions 43 to prevent error fitting. Further, even if the spring 40 does not prevent error fitting, the inner ribs 60 contact parts of the front surface of the front cap 15 other than the error fitting preventing recesses 37 to prevent error fitting.

The male connector M may be mounted on a highly vibrating member such as an engine. In this situation, the wrench W is fit on the outer periphery of the front receptacle 52, as shown in FIG. 22, and tightens the nut N. The wrench W will not interfere with the engaging projections 55, as shown in FIG. 20, because the engaging recesses 54 reduce the height of the engaging projections 55. Further, the engaging recesses 54 are behind the connecting bottom surface 53. Thus, the male connector M can be miniaturized. Specifically, if the engaging recesses were on a front receptacle, the front receptacle would need to be thick to prevent a reduction in strength due to thinning, which leads to the enlargement of the front receptacle. However, this embodiment provides the engaging recesses 54 behind the connecting bottom surface 53 without enlarging the front receptacle 52, so that the male connector M can be miniaturized while reducing the height of the engaging projections 55.

The male and female connectors F, M are connected by positioning the housings 10, 50 in proper connecting postures so that the respective outer ribs 59 are accommodated into the respective guide recesses 33, 34, 39. The male and female connectors F, M then are brought closer to each other. Thus, the engaging portions 43 engage the guiding portions 57 and move onto the guide recesses 58 while deforming the legs 41 away from each other. The engaging portions 43 move onto the front inclined surfaces of the engaging projections 55 as the two housings 10, 50 are brought closer. The legs 41 resiliently return when the engaging portions 43 move over the engaging projections 55, and the engaging portions 43 swiftly fit into the engaging recesses 54 so that the male and female connectors M, F are locked in the properly connected state. At this time, the male and female terminals 51, 11 are connected and the seal ring 16 provides sealing between the front receptacle 52 and the terminal accommodating portion 12, as shown in FIG. 15. Further, the engaging portions 43 engage the engaging surfaces 56 in postures lifted radially outwardly from the bottom surfaces of the engaging recesses 54. In this state, the male and female connectors M, F are biased to be pushed in the connecting direction by the engagement of the engaging portions 43 and the engaging surfaces 56 and do not vibrate in forward and backward directions. Thus, abrasion of the male and female terminals 51, 11 due to fine sliding movements can be avoided.

Figure 18:
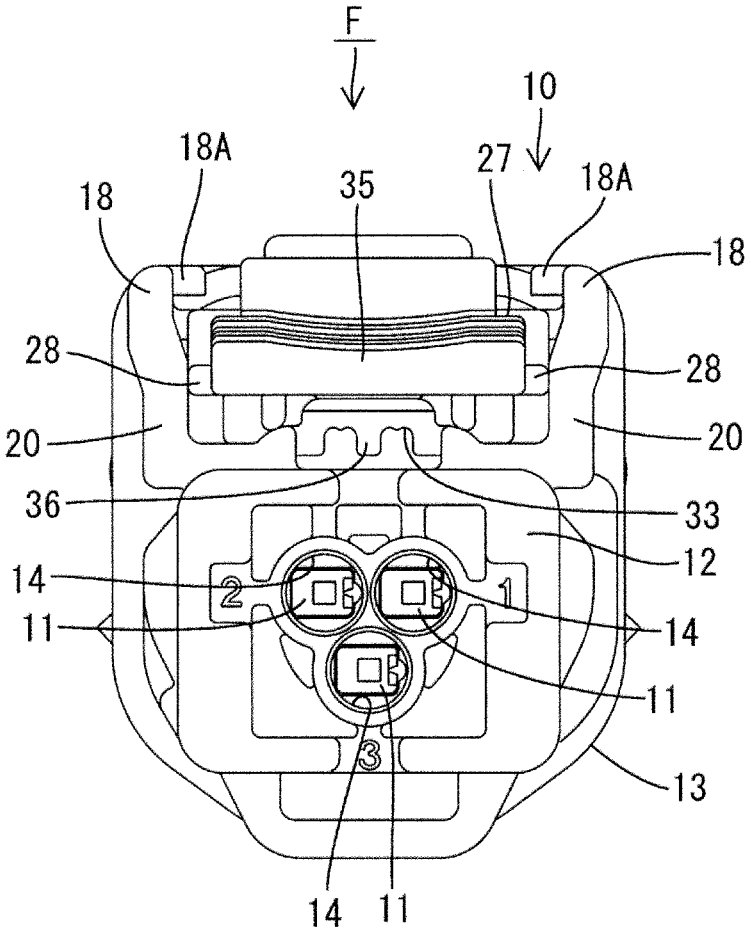
FIG. 18 is a rear view showing the state where the spring is lifted up as the lock arm is unlocked.

To separate the male and female connectors M, F, a finger is hooked on the finger hooking portion 17 and pushes down the unlocking portion 35 of the lock arm 27, thereby setting a state where the supporting recesses 27A of the lock arm 27 are supported on the supporting protrusions 13A of the outer tube 13, as shown in FIG. 17. The lock arm 27 then is pivoted with the supporting protrusions 13A as the supporting points. Thus, the resilient pieces 28 are fit at the inner sides of the displacement preventing walls 20 to prevent lateral displacement of the lock arm 27, as shown in FIG. 18. Accordingly, the pushing portion 29 lifts the upper side 42 of the spring 40 while being kept in the horizontal posture and the engaging portions 43 move to the outsides of the passage paths 25 because the legs 41 move up while being deformed away from each other. If an attempt is made to separate the male and female connectors M, F in a state where locking is released in this way, the engaging projections 55 are pulled out of the outer tube 13 through the passage paths 25 to separate the male and female connectors M, F. The lock arm 27 resiliently returns when the unlocking portion 35 is released from pressing.

As described above, the engaging recesses 54 are behind the connecting bottom surface 53 of the front receptacle 52. Thus, the strength of the front receptacle 52 is not reduced by providing the engaging recesses 54. Further, the engaging recesses 54 are recessed inward of the outer surface of the front receptacle 52. Thus, the wrench W will not interfere with the male housing 50 when the wrench W is fit on the outer periphery of the nut N to tighten the bolt.

The male connector M may be provided with the male housing 50 including the front receptacle 52 and the hexagon nut N held on the rear end part of the male housing 50, and the male housing 50 may have a substantially cylindrical outer shape arranged coaxially with the hexagon nut N. Accordingly, the male connector M can be fastened to a member such as a body of an engine by a bolt by fitting the wrench W onto the outer periphery of the male housing 50 and tightening the nut N.

The engaging portions 43 engage the engaging projections 55 together with the engaging recesses 54, which are provided adjacent to one another in the connecting direction. Thus, the engagement forces with the engaging portions 43 are increased. Further, the height of the engaging projections 55 can be reduced more than when only the engaging projections are provided and engaged with the engaging portions 43.

Accordingly, to provide an engaging recess engageable with a spring while ensuring the strength of a receptacle, the spring lock connector has a male connector M with a front receptacle 52, a female connector F with a terminal accommodating portion 12 to fit into the front receptacle 52, and a spring 40 mounted onto the female connector F and deformed and spread as the female connector F is connected to the male connector M. The male and female connectors M, F are locked in a properly connected state by a spring force of the spring. Engaging recesses 54 for engaging the spring 40 are provided on the outer surface of the male connector M, recessed inward of the outer surface of the front receptacle 52 and arranged more backward than a connecting bottom surface 53 located on a back end side of the inner surface of the front receptacle 52.

The engaging portions 43 move onto the guiding portions 57 to deform and spread the spring 40, and the connecting operation can be performed, if the connecting operation is performed in proper connecting postures. On the other hand, if the connecting operation is performed in improper connecting postures, parts of the opening edge part of the front receptacle 52 other than the guiding portions 57 contact the engaging portions 43 and prevent connection. Further, it is sufficient to provide small ribs on the outer peripheral edge of the front receptacle 52. Thus, miniaturization of the connector is possible.

The guide recesses 58 may be provided on the outer peripheral surface of the front receptacle 52 for guiding the engaging portions 43 in the connecting direction after the engaging portions 43 move onto the guiding portions 57. Accordingly, the rotation or improper displacement of the front receptacle 52 during the connecting operation can be prevented.

The engaging portions 43 may be provided on opposite sides of the front receptacle 52, and the guide recesses 58 may be provided on opposite sides of the front receptacle 52, in correspondence with the engaging portions 43 to suppress separation of the spring 40 from the female connector F when the engaging portions 43 are engaged with the guide recesses 58.

The rear end part of the lock arm 27 is fit into the clearance between the displacement preventing walls 20 together with the resilient pieces 28 to prevent lateral displacements of the lock arm 27. Thus, both legs 41 are lifted up simultaneously when the spring 40 is lifted up by the lock arm 27. Specifically, locking can be reliably released by lifting up the left and right legs 41.

The protection walls 18 may be continuously provided on the upper edges of the displacement preventing walls 20. Accordingly, the rear end of the lock arm 27 located between the protection walls 18 is guided more easily into the clearance between the displacement preventing walls 20, since the protection walls 18 and the displacement preventing walls 20 are formed continuously and integrally.

The left and right supporting protrusions 13A for supporting the lock arm 27 are provided below the lock arm 27 in the female connector F, and the left and right supporting recesses 27A are provided on the lower surface of the lock arm 27 for individually receiving the supporting protrusions 13A when the lock arm 27 is unlocked. Accordingly, the left and right supporting protrusions 13A are received into the supporting recesses 27A to hold the lock arm 27 in a proper substantially horizontal posture.

The female connector F may include the escaping portion 19 for allowing the rear end part of the lock arm 27 to escape when the lock arm 27 is unlocked. Accordingly, a deflection amount of the lock arm 27 can be increased by allowing the rear end part of the lock arm 27 to escape into the escaping portion 19.

Each supporting protrusion 13A may include the front and rear inclined surfaces, and the rear inclined surface may be sloped more steeply down than the front inclined surface. Accordingly, the front inclined surface can be longer in forward and backward directions than the rear inclined surface, and a force received from the lock arm 27 when the lock arm 27 is unlocked can be dispersed in a wider range and the strength of the supporting protrusion 13A can be increased. The extension of the front inclined surface does not hinder an unlocking operation since the front inclined surface does not interfere with the rear part of the lock arm 27 when the lock arm 27 is unlocked.

The invention is not limited to the above described embodiment. For example, the following embodiments are also included in the scope of the invention.

The hexagon nut N is tightened using the hexagon wrench W in the above embodiment. However, a tool with which the male housing 50 interferes is not limited to the hexagon wrench W and the invention is applicable also when another tool interferes with the male housing.

The engaging surfaces may be formed only by the engaging recesses without providing the engaging projections.

The guides 57 are formed by the cuts and the slanted surfaces continuous with the cuts in the above embodiment. However, the guides 57 can have other shapes.

The guide recesses 58 are in areas including the front inclined surfaces of the engaging projections 55 in the above embodiment. However, they need not include the front inclined surfaces of the engaging projections 55.

Two engaging portions 43 are provided in the above embodiment, but only one engaging portion or three or more engaging portions may be provided.

The lock arm 27 is supported by the resilient pieces 28 in the posture lifted from the upper surface of the outer tube 13 in the above embodiment. However, the lock arm may be supported directly on the supporting protrusions.

The protection walls 18 and the displacement preventing walls 20 are connected in the above embodiment, but they may be formed separately.

The escaping portion 19 penetrates through the outer tube 13 in the above embodiment, but a tapered surface may be formed without penetrating through the outer tube 13 and this tapered surface may serve as an escaping portion.

The front inclined surface of the supporting protrusion is sloped down more moderately than the rear inclined surface thereof in the above embodiment. However, the front and rear inclined surfaces may be sloped equally.

What is claimed is:

1. A spring lock type connector, comprising:

a first connector with a receptacle;

a second connector with a terminal accommodating portion to be fit into the receptacle; and a spring mounted onto the second connector and deformed and spread as the second connector is connected to the first connector, the first and second connectors being locked in a properly connected state by a spring force of the spring, wherein at least one engaging recess is provided on the outer surface of the first connector and is engageable with the spring, the engaging recess is recessed inwardly of the outer surface of the receptacle and is more backward than a connecting bottom surface located on a back end side of the inner surface of the receptacle.

2. The spring lock type connector of claim 1, wherein the terminal accommodating portion is fittable on an inner peripheral side of the receptacle.

3. The spring lock type connector of claim 1, further comprising at least one engaging projection provided substantially continuously before the engaging recess in a connecting direction, the engaging recess and the engaging projection forming an engaging surface and the spring being engageable with the engaging surface.

4. The spring lock type connector of claim 1, wherein the first connector includes a first housing with the receptacle and a nut held on a rear end part of the first housing.

5. The spring lock type connector of claim 4, wherein the first housing has a substantially cylindrical outer shape and is arranged coaxially with the nut.

6. The spring lock type connector of claim 1, wherein:

the spring includes at least one engaging portion to be arranged in an entrance path for the receptacle; and at least one guide provided on an opening edge of the receptacle and being engaged with the engaging portion if a connecting operation is performed in proper connecting postures and a part of the opening edge of the receptacle other than the guiding portion contacting the engaging portion to prevent the connecting operation if the connecting operation is performed in improper connecting postures.

7. The spring lock type connector of claim 6, wherein at least one guide recess is provided on the outer peripheral surface of the receptacle for guiding the engaging portion in a connecting direction after the engaging portion moves onto the guiding portion.

8. The spring lock type connector of claim 7, wherein two of the engaging portions are provided at substantially opposite sides of the receptacle, two of the guide recesses are provided on substantially opposite sides of the receptacle substantially in correspondence with the engaging portions, and the separation of the spring from the second connector is suppressed in a state where the engaging portions are engaged with the guide recesses.

9. The spring lock type connector of claim 1, wherein the spring includes two lateral legs deformable to spread as the second connector is connected to the first connector, the first and second connectors being locked in a properly connected state by a spring force of the spring.

10. The spring lock type connector of claim 9, wherein the second connector includes a lock arm capable of releasing locking by lifting up the spring, two lateral protection walls arranged at substantially opposite lateral sides of the lock arm, two lateral resilient pieces extending in substantially forward and backward directions between the lock arm and the protection walls and coupling the lock arm and the protection walls, and a pair of lateral displacement preventing walls provided at an interval narrower than the protection walls below the protection walls, and a rear end part of the lock arm is fit into a clearance between the displacement preventing walls together with the resilient pieces when the lock arm is unlocked, thereby preventing lateral displacements of the lock arm.

11. A spring lock type connector of claim 10, wherein the protection walls are provided continuously on the outer edges of the displacement preventing walls, and wherein two lateral supporting protrusions are provided below the lock arm in the second connector for supporting the lock arm at two points, and two lateral supporting recesses are provided on the lower surface of the lock arm for individually receiving the supporting protrusions when the lock arm is unlocked, and wherein the second connector includes an escaping portion for allowing the rear end part of the lock arm to escape when the lock arm is unlocked, wherein each of the supporting protrusion includes a front inclined surface and a rear inclined surface, and the front inclined surface is more moderately downward sloped than the rear inclined surface.

* * * * *